United States Patent [19]

Kikuchi et al.

[11] Patent Number: 5,068,051

[45] Date of Patent: Nov. 26, 1991

[54] CLEANING SOLVENT

[75] Inventors: Hideaki Kikuchi; Motosuke Ogawa, both of Shimizu; Akira Niiyama, Mitaka, all of Japan

[73] Assignees: Dupont-Mitsuj Fluorochemicals Co., Ltd.; Mitsui Petrochemical Industries, Ltd., both of Tokyo, Japan

[21] Appl. No.: 454,265

[22] Filed: Dec. 21, 1989

[30] Foreign Application Priority Data

Dec. 29, 1988 [JP] Japan ..... 63-335030
Mar. 2, 1989 [JP] Japan ..... 1-50748

[51] Int. Cl.[5] ..... C11D 7/50; C11D 7/32; B01F 1/00

[52] U.S. Cl. ..... 252/162; 252/153; 252/170; 252/171; 252/364; 252/DIG. 8; 252/DIG. 9

[58] Field of Search ..... 252/364, DIG. 9, DIG. 8, 252/170, 171, 153, 162

[56] References Cited

U.S. PATENT DOCUMENTS 3,940,342 2/1976 Hutchinson ..... 252/171
4,002,573 1/1977 Hutchinson ..... 252/171
4,092,262 5/1978 Reusser ..... 252/DIG. 9
4,096,083 6/1978 Clementson et al. ..... 252/DIG. 9
4,243,548 1/1981 Heeb et al. ..... 252/364
4,260,509 4/1981 Douda et al. ..... 252/DIG. 8
4,260,510 4/1981 Hey et al. ..... 252/DIG. 8
4,268,407 5/1981 Hey et al. ..... 252/364
4,517,108 5/1985 Hisamoto et al. ..... 252/172
4,816,176 3/1989 Lund et al. ..... 252/DIG. 9

FOREIGN PATENT DOCUMENTS 89230940 12/1987 Japan .

*Primary Examiner*—Paul Lieberman
*Assistant Examiner*—William S. Parks
*Attorney, Agent, or Firm*—Birch, Stewart, Kolasch & Birch

[57] ABSTRACT

A mixed cleaning solvent containing dichlorotrifluoroethane and dimethoxymethane without containing Flon #113, which is suitable for cleaning and degreasing printed circuit boards and for eliminating flux residues and dust particles adhering thereon and which reveals high cleaning ability without occurrence of whity specks of volatilization residues including ionic residues on the treated surface with possible attainment of high stability to decomposition of the solvent component.

16 Claims, 1 Drawing Sheet

45
40
35
30
27
0
Temperature (°C)
A
B
Curve A : Boiling Point
Curve B : Dew Point
0
50
100
Weight % of Flon #123

CLEANING SOLVENT

FIELD OF THE INVENTION

The present invention relates to a cleaning solvent and, more specifically, to a cleaning solvent for cleaning and eliminating flux residues, dust particles and greasy contaminants on printed circuit boards.

PRIOR ART

For cleaning printed circuit boards, there have, in practice, been employed widely cleaning solvents of azeotropic ternary mixture, such as those composed of 1,1,2-trichloro-1,2,2-trifluoroethane (Flon #113), ethanol and nitoromethane (disclosed in U.S. Pat. No. 3,903,009 and in the corresponding Japanese Patent Kokai No. 80983/1975) and those composed of Flon #113, methanol and nitromethane (disclosed in U.S. Pat. No. 3,960,746 and in the corresponding Japanese Patent Kokai No. 44575/1976).

However, the ternary azeotropic mixed solvents mentioned above do not always reveal better cleaning performance and may often bring about whity specks of volatilization residues and ionic residues, which might have caused troubles in the production course. In addition, there is a demand for alternative solvent replaceable for Flon #113.

SUMMARY OF THE INVENTION

An object of the present invention is to provide a cleaning solvent which contains no Flon #113, permits employment of existing cleaning apparatus for use for Flon #113 as such, exhibits a high cleaning ability and does not cause the whity specks of volatilization residues including ionic residues to occur on the treated surfaces.

Another object of the present invention is to provide a cleaning solvent which contains no Flon #113, exhibits a high cleaning ability with a high stability and does not cause whity specks of volatilization residues including ionic residues to occur on the treated surfaces.

The above objects can be attained by a cleaning solvent containing dichlorotrifluoroethane and dimethoxymethane according to the present invention.

DETAILED DESCRIPTION OF THE INVENTION

Figure 1:
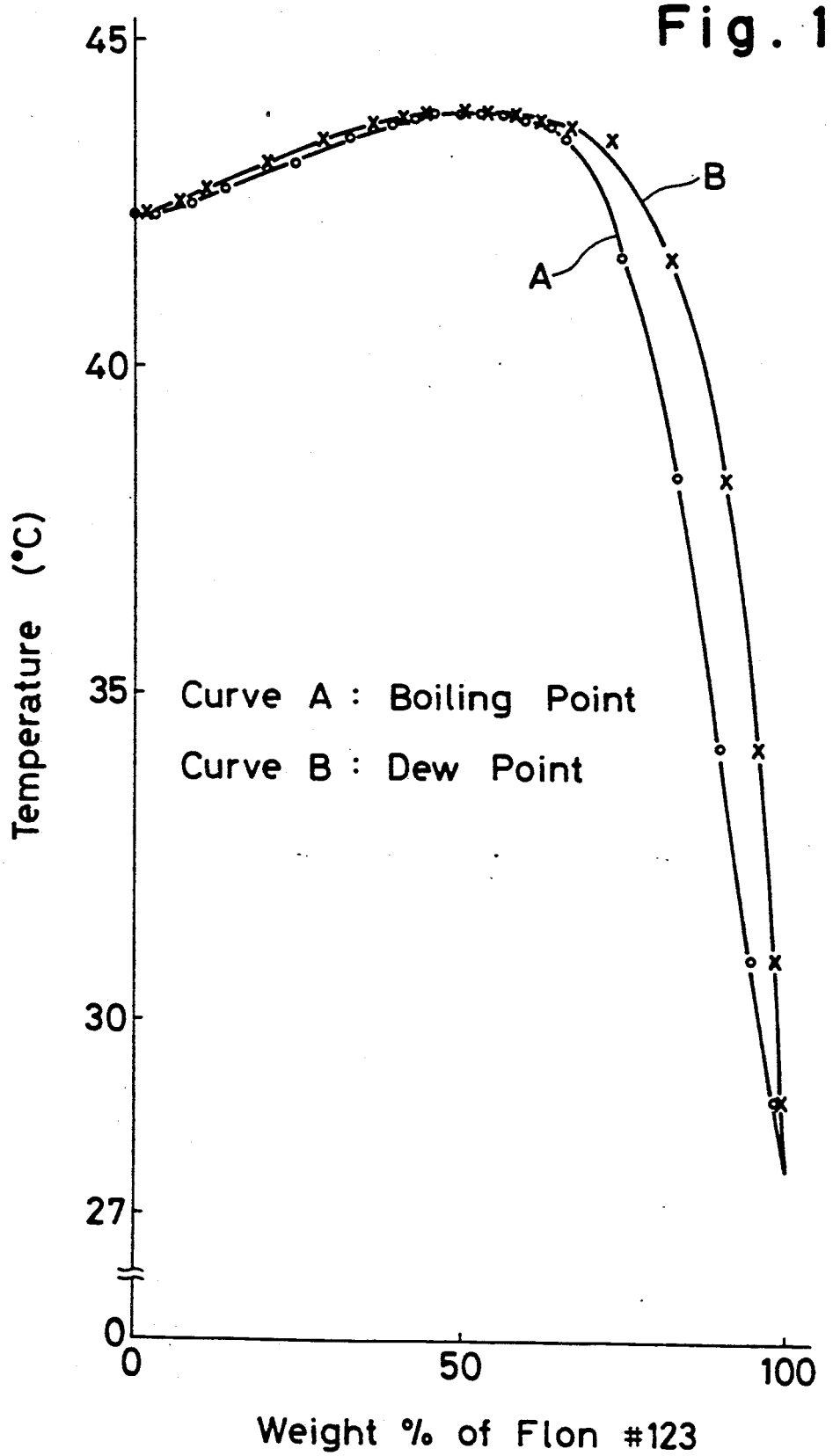
FIG. 1 is a diagram for the vapor-liquid equillibrium of the system dichlorotrifluoroethane/dimethoxymethane as given in Example 1.

Examples of the dichlorotrifluoroethane to be incorporated as one of the principal constituent of the cleaning solvent according to the present invention include 1,1-dichloro-2,2,2-trifluoroethane, 1,1-dichloro-1,2,2-trifluoroethane, 1,2-dichloro-1,1,2-trifluoroethane and so on, among which especially 1,1-dichloro-2,2,2-trifluoroethane is preferable.

The mixing proportion of the dichlorotrifluoroethane (hereinafter referred to as Flon #123) to dimethoxymethane (namely, $CH_3O—CH_2—OCH_3$; referred to hereinafter as DMM) ranges from 5:95 to 70:30, preferably from 40:60 to 60:40, on weight basis. If the proportion of Flon #123 in the cleaning solvent is short of 5% by weight, the cleaning ability becomes too low and is not preferable. If it exceeds 70% by weight, the difference in the composition between the vapor phase and the liquid phase of the cleaning solvent becomes too large, so that the cleaning solvent will not permit its repeated use.

The cleaning solvent according to the present invention can be prepared by simply mixing Flon #123 with DMM in a mixing proportion as given above, while it is possible on requirement to admix other solvents, additives and so on to the binary solvent mixture. It is in particular preferable to incorporate in the cleaning solvent a stabilizing agent.

The stabilizing agent to be employed according to the invention consists of one or more compounds selected from the group consisting of nitroalkanes, 2-methylfuran, propylene oxide and epoxybutane. Among them, especially nitroalkanes, 2-methylfuran and propylene oxide are preferred.

Examples of nitroalkanes include nitromethane, nitroethane, 1-nitropropane and so on.

The amount of the stabilizing agent to be incorporated in the cleaning solvent according to the invention may range from 0.01 to 5%, preferably from 0.1 to 1%, based on the weight of the binary mixture of dichlorotrifluoroethane and dimethoxymethane. If the amount of stabilizing agent is short of 0.01% by weight, the stabilizing effect becomes too low to satisfy the stability of the cleaning solvent. If the amount exceeds 5% by weight, there occurs a fear of remaining of the stabilizing agent left on the treated surface after the cleaning.

The cleaning solvent according to the present invention containing the stabilizing agent can be prepared by simply mixing Flon #123 and dimethoxymethane in a proportion as mentioned above and adding thereto said stabilizing agent in a weight proportion as described above. This cleaning solvent may contain, if necessary, other solvents, additives and so on.

While the cleaning solvent prepared as above, can be used for general cleaning purposes, it is especially suitable for removing flux residues and dust particles on printed circuit boards and for degreasing them.

For effecting cleaning of various objective items by the cleaning solvent according to the present invention, conventional cleaning methods for similar cleaning solvents of prior art, such as, soaking, spraying, vapor cleaning and combinations of them may be employed. Here, it is possible to apply heating, irradiation of ultrasonic wave etc. upon the cleaning.

The cleaning solvent composed essentially of Flon #123 and DMM according to the present invention has an azeotropic point of at the maximum of 43.9° C. which is close to the boiling point of Flon #113 (47.6° C.), so that existing cleaning apparatuses for use for Flon #113 can be utilized as such.

The binary azeotropic mixture of Flon #123 and DMM exhibits a superior ability of cleaning of printed circuit board etc. than that of the conventional ternary mixed solvents composed of Flon #113, ethanol (methanol) and nitromethane. However, a binary mixture composed only of Flon #123 and DMM may tend to suffer from decomposition of the component solvent, when used in a system including a segment or part of highly reactive metal such as zinc etc., under formation of acidic decomposition product, causing thus corrosion of the metal parts. If, however, the stabilizing agent according to the present invention is incorporated in such a binary mixture, the mixture becomes highly stable and the decomposition of the component solvent upon contact with metal surface of such a highly reactive metal as zinc or the like is excluded and, thus, the formation of acidic decomposition product and corrosion of metal parts will not occur.

As described above, by the combination of Flon #123 with DMM according to the present invention, a superior mixed cleaning solvent can be obtained which exhibits advantageous properties such as follows:

There is no need for employing Flon #113.

Existing cleaning apparatuses for use for Flon #113 can be utilized as such.

The cleaning ability is high with exclusion of occurrence of whity specks due to volatilization residues including ionic residues on the treated surface.

PREFERRED EMBODIMENTS

Below, the invention will further be described by way of Examples.

EXAMPLE 1

In a flask equipped with a reflux condenser, 200 g of a mixture prepared by mixing Flon #123 (1,1-dichloro-2,2,2-trifluoroethane) and dimethoxymethane (DMM) in a weight proportion of 50:50 were charged and the mixture was heated by a heater. After the temperature of the liquid phase inside the flask had become steady within about 30 minutes, the compositions of the liquid phase and of the vapor phase were determined by analysis.

By repeating these procedures using mixtures of Flon #123 and DMM having various compositions, the variations in the boiling temperature of the liquid phase and in the condensation temperature (dew point) of the vapor phase upon variation of the mixture composition were observed by plotting them on a liquid/vapor equillibrium diagram as given in FIG. 1. In this Figure, the curve A represents the variation course of the boiling point and the curve B the dew point.

As seen from FIG. 1, the mixture of Flon #123 and DMM exhibits an azeotropic point at a mixing proportion by weight of about 50:50 at which the composition of the vapor phase is equal to that of the liquid phase and, in addition, the boiling point thereof is by about 15° C. higher than the boiling point of Flon #123, which lies at about ordinary temperature, enabling thus easy handling in the cleaning operation. This binary mixture exhibits a pseudo-azeotropism in the composition range of 5–70% by weight of Flon #123 with small composition difference between the liquid phase and the vapor phase, as seen from FIG. 1.

EXAMPLE 2

A printed circuit board of square form having a side length of 65 mm was coated with 60 μl of a soldering flux of varying kind, as given in Table 1 below, uniformly and the so coated board was preheated to a temperature of 100° C., whereupon soldering was effected thereon in a soldering bath at a temperature of 260° C. at a soldering rate of 2 feet per minute.

After the solering, the printed circuit board was stood at room temperature for 1 hour, whereupon it was cleaned using a cleaning solvent consisting of 50% by weight of Flon #123 and 50% by weight of DMM.

The cleaning was effected by boiling soak for 30 sec., followed by soaking with irradiation of ultrasonic wave for 60 sec. and then by vapor cleaning for 30 sec.

Occurrence of any whity speck of volatilization residue on the printed circuit board after cleaning was detected visually and that of ionic residue was detected by an Omega Meter (of Kenco Co.). Results are summarized in Table 1.

COMPARATIVE EXAMPLE 1

A similar cleaning test as in Example 2 was carried out using an azeotropic mixed solvent composed of 95.7% by weight of Flon #113, 3.8% by weight of ethanol and 0.5% by weight of nitromethane. Results are given also in Table 1.

The data for the ionic residue in Table 1 is given by the percent proportion relative to the MIL Specification.

TABLE 1

| | Whity Speck[2] | | Ionic Residue (%) | |
|---|---|---|---|---|
| Flux[1] | Example 2 | Comp. Ex. 1 | Example 2 | Comp. Ex. 1 |
| A | ○ | Δ | 14 | 18 |
| B | ○ | ○ | 18 | 31 |
| C | Δ | Δ | 41 | 43 |
| D | ○ | × | 14 | 34 |
| E | ○ | ○ | 16 | 26 |

[1]:
A = Sparcle Flux PO-F-309H (Trademark of Senju metal industry Co.)
B = S.A. Flux S-507 (Trademark of Senju metal industry Co.)
C = Solbond RA815-35 (Trademark of Alpha metal Co.)
D = Solbond R 100-40 (Trademark of Alpha metal Co.)
E = SA 2002-M (Trade name of Hi-Grade Alloy Co.)
[2]: Visual evaluation rank
○ = No speck is found
Δ = Almost no whity speck
× = Specks are found

EXAMPLE 3

To 99.5 parts by weight of a binary mixture of Flon #123 and DMM of a mixing proportion of 50/50 on weight basis, each 0.5 part by weight of each of the stabilizing agents as given in Table 2, including comparative ones, was admixed to formulate a test cleaning solvent.

4 g of the test cleaning solvent were charged in a glass tube having an inner diameter of 11 mm and therein was placed submergedly in the test cleaning solvent a metal piece made of iron, aluminum or zink having a size of 8 mm (width)×60 mm (length)×1 mm (thickness), whereupon the glass tube was sealed. The sealed tube was stored for 4 days at 100° C., whereupon the tube was cut open at its top end and the test solvent was taken out and shaken with an amount of deionized water sufficiently. The aqeuous phase was separated and the concentration of chloride ion in the aqueous phase was determined by ion chromatography. Results are summarized in Table 2

TABLE 2

| | Stabilizing Agent | Chloride Ion Conc. (ppm) |
|---|---|---|
| Accordg. to the Invent. | Nitromethane | 56 |
| | Nitroethane | 82 |
| | 2-methylfuran | 83 |
| | Propylene oxide | 101 |
| | Epoxybutane | 278 |
| Compar. | N-methylmorpholine | 1949 |
| | 1-methylpyrrole | 2318 |
| | Diisopropylamine | 2522 |
| Blank | — | 2117 |

As seen from Table 2, nitroalkanes, 2-methylfuran, propylene oxide and epoxybutane have high stabilizing effect, in which the former three have remarkable performance as stabilizing agent.

EXAMPLE 4

A printed circuit board of square form having a side length of 45 mm was coated with 60 μl of a soldering flux of varying kind, as given in Table 3 below, uniformly and the so coated board was preheated to a temperature of 100° C., whereupon soldering was effected thereon in a soldering bath at a temperature of 260° C. at a soldering rate of 2 feet per minute.

After the soldering, the printed circuit board was stood at room temperature for 1 hour, whereupon it was cleaned using a cleaning solvent consisting of 50% by weight of Flon #123, 49.5% by weight of DMM and 0.5% by weight of nitromethane.

The cleaning was effected by boiling soak for 30 sec., followed by soaking with irradiation of ultrasonic wave for 60 sec. and then by vapor cleaning for 30 sec.

Occurrence of any whity speck of volatilization residue on the printed circuit board after cleaning was detected visually and that of ionic residue was detected by an Omega Meter (of Kenco Co.). Results are summarized in Table 3.

COMPARATIVE EXAMPLE 2

A similar cleaning test as in Example 4 was carried out using an azeotropic mixed solvent composed of 95.7% by weight of Flon #113, 3.8% by weight of ethanol and 0.5% by weight of nitromethane. Results are given also in Table 3.

The data for the ionic residue in Table 1 is given by the percent proportion relative to the MIL Specification.

TABLE 3

| | Whity Speck[2)] | | Ionic Residue (%) | |
|---|---|---|---|---|
| Flux[1)] | Example 4 | Comp. Ex. 2 | Example 4 | Comp. Ex. 2 |
| A | ○ | Δ | 14 | 18 |
| B | ○ | ○ | 23 | 31 |
| C | Δ | Δ | 36 | 43 |
| D | ○ | × | 18 | 34 |
| E | ○ | ○ | 18 | 26 |

1):
A = Sparcle Flux PO-F-309H (Trademark of Senju metal industry Co.)
B = S.A. Flux S-507 (Trademark of Senju metal industry Co.)
C = Solbond RA815-35 (Trademark of Alpha metal Co.)
D = Solbond R 100-40 (Trademark of Alpha metal Co.)
E = SA 2002-M (Trade name of Hi-Grade Alloy Co.)
2): Visual evaluation rank
○ = No speck is found
Δ = Almost no whity speck
× = Specks are found

We claim:

1. An azeotropic cleaning solvent composition, consisting essentially of a dichlorotrifluoroethane, selected from the group consisting of 1,1-dichloro-2,2,2-trifluoroethane, 1,1-dichloro-1,2,2-trifluoroethane and 1,2-dichloro-1,1,2-trifluoroethane, and dimethoxymethane in a weight proportion of said dimethoxymethane to said dichlorotrifluoroethane in the range from 5:95 to 70:30, wherein said dichlorotrifluoroethane is present in an amount of from 5 percent to 70 percent by weight of the entire composition, wherein said composition has a boiling point of about 49.3° C. at 1 atmosphere of pressure.

2. An azeotropic cleaning solvent composition as claimed in claim 1, further comprising a stabilizing agent in an amount of from 0.01 to 5%, based on the weight of said composition.

3. An azeotropic cleaning solvent composition as claimed in claim 2, wherein said stabilizing agent consists of one or more compounds selected from the group consisting of nitroalkanes, 2-methylfuran, propylene oxide, and epoxybutane.

4. An azeotropic cleaning solvent composition, consisting essentially of dichlorotrifluoroethane and dimethoxymethane as in claim 1, 2, or 3, wherein the weight proportion of the former to the latter is in the range from 40:60 to 60:40 on a weight basis, and wherein said dichlorotrifluoroethane is present in an amount of from 5 percent to 70 percent by weight of the entire composition.

5. An azeotropic cleaning solvent composition, consisting essentially of dichlorotrifluoroethane and dimethoxymethane as in claim 1, 2, or 3, wherein the weight proportion of the former to the latter is in the proportion of about 50:50 on a weight basis.

6. An azeotropic cleaning solvent composition as claimed in claim 1, wherein said dichlorotrifluoroethane is 1,1-dichloro-2,2,2-trifluoroethane.

7. An azeotropic cleaning solvent composition as claimed in claim 2, wherein said stabilizing agent is present in an amount of from 0.1 to 1 percent, based on the weight of said composition.

8. An azeotropic cleaning solvent composition as claimed in claim 3, wherein said nitroalkanes are selected from the group consisting of nitromethane, nitroethane, and 1-nitropropane.

9. An azeotropic cleaning solvent composition as claimed in claim 4, wherein said dichlorotrifluoroethane is 1,1-dichloro-2,2,2-trifluoroethane.

10. Cleaning solvent composition as claimed in claim 5, wherein said dichlorotrifluoroethane is 1,1-dichloro-2,2,2-trifluoroethane.

11. An azeotropic cleaning solvent composition, consisting essentially of 99.5 percent by weight of a 50:50 mixture by weight of a dichlorotrifluoroethane selected from the group consisting of 1,1-dichloro-2,2,2-trifluoroethane, 1,1-dichloro-1,2,2-trifluoroethane and 1,2-dichloro-1,1,2-trifluoroethane and dimethoxymethane, and 0.5 percent by weight of a stabilizing agent wherein said composition has a boiling point of about 49.3° C. at 1 atmosphere pressure.

12. An azeotropic cleaning solvent composition as claimed in claim 11, wherein said dichlorotrifluoroethane is 1,1-dichloro-2,2,2-trifluoroethane.

13. An azeotropic cleaning solvent composition as claimed in claim 11, wherein said stabilizing agent is selected from the group consisting of nitroalkanes, 2-methylfuran, propylene oxide, and epoxybutane.

14. An azeotropic cleaning solvent composition as claimed in claim 13, wherein said nitroalkanes are selected from the group consisting of nitromethane, nitroethane, and 1-nitropropane.

15. An azeotropic cleaning solvent composition, consisting essentially of 50 percent by weight of a dichlorotrifluoroethane, 49.5 percent by weight of dimethoxymethane selected from the group consisting of 1,1-dichloro-2,2,2-trifluoroethane, 1,1-dichloro-1,2,2-trifluoroethane and 1,2-dichloro-1,1,2-trifluoroethane, and 0.5 percent by weight of nitromethane, wherein said composition has a boiling point of about 49.3° C. at 1 atmosphere pressure.

16. An azeotropic cleaning solvent composition as claimed in claim 15, wherein said dichlorotrifluoroethane is 1,1-dichloro-2,2,2-trifluoroethane.

* * * * *

UNITED STATES PATENT AND TRADEMARK OFFICE

CERTIFICATE OF CORRECTION

PATENT NO. : 5,068,051

DATED : November 26, 1991

INVENTOR(S) : Hideaki Kikuchi et al.

It is certified that error appears in the above-identified patent and that said Letters Patent is hereby corrected as shown below:

Column 5, line 6, change "dimethoxymethane" to --dichlorotrifluoroethane--;

line 7, change "dichlorotrifluoroethane" to --dimethoxymethane--; and line 11, change "49.3°C" to --43.9°C--.

Column 6, line 4, change "the former to the latter" to --said dichlorotrifluoroethane to said dimethoxymethane--.

Column 6, line 4, change "the former to the latter" to --said dichlorotrifluoroethane to said dimethoxymethane--.

Column 6, line 1, change "Cleaning solvent composition" to --An azeotropic cleaning solvent composition--.

Column 6, line 9, change "49.3°C" to --43.9°C--.

UNITED STATES PATENT AND TRADEMARK OFFICE

CERTIFICATE OF CORRECTION

PATENT NO. : 5,068,051

DATED : November 26, 1991

INVENTOR(S) : Hideaki Kikuchi et al.

It is certified that error appears in the above-indentified patent and that said Letters Patent is hereby corrected as shown below:

Column 6, lines 3-4, delete ", 49.5 percent by weight of dimethoxymethane";

line 6, before "and" (second occurrence) insert --49.5 percent by weight of dimethoxymethane,--; and line 8, change "49.3°C" to --43.9°C--.

Signed and Sealed this

Thirty-first Day of May, 1994

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,068,051

DATED : November 26, 1991

INVENTOR(S) : Hideaki Kikuchi et al

It is certified that error appears in the above-indentified patent and that said Letters Patent is hereby corrected as shown below:

Column 5, line 55, change "dimethoxymethane" to --dichlorotrifluoroethane--;

line 56, change "dichlorotrifluoroethane" to --dimethoxymethane--; and line 60, change "49.3°C" to --43.9°C--.

Column 6, line 7, change "the former to the latter" to --said dichlorotrifluoroethane to said dimethoxymethane--.

Column 6, line 15, change "the former to the latter" to --said dichlorotrifluoroethane to said dimethoxymethane--.

UNITED STATES PATENT AND TRADEMARK OFFICE

CERTIFICATE OF CORRECTION

PATENT NO. : 5,068,051

DATED : November 26, 1991

INVENTOR(S) : Hideaki Kikuchi et al

It is certified that error appears in the above-indentified patent and that said Letters Patent is hereby corrected as shown below:

Column 6, line 31, change "Cleaning solvent composition" to --An azeotropic cleaning solvent composition--.

Column 6, line 42, change "49.3°C" to --43.9°C--.

Column 6, lines 57-58, delete ", 49.5 percent by weight of dimethoxymethane";

line 60, before "and" (second occurrence) insert --49.5 percent by weight of dimethoxymethane,--; and line 62, change "49.3°C" to --43.9°C--. .

This certificate supersedes certificates of correction issued May 31, 1994.

Signed and Sealed this

Twenty-fifth Day of April, 1995

*Attest:*

Bruce Lehman

BRUCE LEHMAN

*Attesting Officer*

*Commissioner of Patents and Trademarks*